US011998795B2

(12) United States Patent
Zhu et al.

(10) Patent No.: US 11,998,795 B2
(45) Date of Patent: Jun. 4, 2024

(54) COMPREHENSIVE PHYSICAL EXERCISING APPARATUS WITH RUNNING EXERCISING FUNCTION AND STRENGTH EXERCISING FUNCTION

(71) Applicant: Shenzhen Yuanzhichuang Technology Co., Ltd., Shenzhen (CN)

(72) Inventors: Yuanwen Zhu, Shenzhen (CN); Jun Lu, Shenzhen (CN)

(73) Assignee: Shenzhen Yuanzhichuang Technology Co., Ltd., Shenzhen (CN)

( * ) Notice: Subject to any disclaimer, the term of this patent is extended or adjusted under 35 U.S.C. 154(b) by 365 days.

(21) Appl. No.: 17/564,754

(22) Filed: Dec. 29, 2021

(65) Prior Publication Data

US 2022/0409950 A1 Dec. 29, 2022

(30) Foreign Application Priority Data

Jun. 25, 2021 (CN) ..... 202110713203.5

(51) Int. Cl.
*A63B 22/00* (2006.01)
*A63B 21/00* (2006.01)
*A63B 23/035* (2006.01)

(52) U.S. Cl.
CPC ..... *A63B 22/0002* (2013.01); *A63B 21/154* (2013.01); *A63B 21/4035* (2015.10);
(Continued)

(58) Field of Classification Search
CPC ... A63B 21/0058; A63B 21/02; A63B 21/023; A63B 21/151; A63B 21/154;
(Continued)

(56) References Cited

U.S. PATENT DOCUMENTS 5,318,491 A * 6/1994 Houston ..... A63B 22/02 482/4
5,527,245 A * 6/1996 Dalebout ..... A63B 21/154 482/54

(Continued)

FOREIGN PATENT DOCUMENTS

CN 208611693 U * 3/2019
CN 110237487 A * 9/2019 ..... A63B 21/05

(Continued)

*Primary Examiner* — Gary D Urbiel Goldner

(57) ABSTRACT

A comprehensive physical exercising apparatus with running exercising function and strength exercising function is provided and relates to the field of fitness equipment. The apparatus includes a base, a strength exercising unit disposed on the base, and a running exercising unit disposed on the base and used for running exercising of fitness personnel. The strength exercising unit includes a force-adjustable rotary device fixedly connected in the base and used for providing a load during the strength exercising of fitness personnel; and pulling ropes fixedly connected to the force-adjustable rotary device. During strength exercising, the fitness personnel pulls the force-adjustable rotary device through the pulling ropes. By setting the strength exercising unit and the running exercising unit, the apparatus has the functions of strength exercising and running exercising, provides the functional diversity of fitness equipment, and reduces the cost investment of family fitness equipment.

8 Claims, 3 Drawing Sheets

(52) U.S. Cl.
CPC .... *A63B 22/0025* (2015.10); *A63B 23/03558* (2013.01); *A63B 2220/51* (2013.01); *A63B 2225/10* (2013.01)

(58) Field of Classification Search
CPC ..... A63B 21/4035; A63B 22/0002; A63B 22/0025; A63B 22/0046; A63B 22/02; A63B 23/03558; A63B 2210/50; A63B 2220/51; A63B 2225/09; A63B 2225/093; A63B 2225/10
See application file for complete search history.

(56) References Cited

U.S. PATENT DOCUMENTS 5,951,449 A * 9/1999 Oppriecht ..... A63B 21/156 482/54
6,123,649 A * 9/2000 Lee ..... A63B 21/4013 482/54
7,052,440 B2 * 5/2006 Pyles ..... A63B 21/0051 482/121
7,575,537 B2 * 8/2009 Ellis ..... A63B 21/4035 482/54
7,878,950 B1 * 2/2011 Bastian ..... A63B 21/4035 482/54
8,172,729 B2 * 5/2012 Ellis ..... A63B 21/4035 482/54
10,363,451 B2 * 7/2019 Porteros De Luz ..... A63B 24/0087
10,426,989 B2 * 10/2019 Dalebout ..... A63B 21/0442
10,569,121 B2 * 2/2020 Watterson ..... A63B 23/03558
10,668,320 B2 * 6/2020 Watterson ..... A63B 23/03566
10,987,544 B2 * 4/2021 Root, Jr. ..... A63B 71/0622
2004/0204294 A2 * 10/2004 Wilkinson ..... A63B 22/203 482/52
2005/0124471 A1 * 6/2005 Wilkinson ..... A63B 21/4021 482/121
2007/0232463 A1 * 10/2007 Wu ..... A63B 22/0257 482/54
2007/0287601 A1 * 12/2007 Burck ..... A63B 22/02 482/54
2010/0279827 A1 * 11/2010 Farnsworth ..... A63B 21/4035 482/54
2011/0118089 A1 * 5/2011 Ellis ..... A63B 21/4035 482/54
2011/0281691 A1 * 11/2011 Ellis ..... A63B 23/047 482/54
2011/0312474 A1 * 12/2011 Ellis ..... A63B 22/0235 482/54
2015/0352399 A1 * 12/2015 Chen ..... A63B 22/02 482/54
2016/0001119 A1 * 1/2016 Jue ..... A63B 21/00069 482/54
2020/0222266 A1 * 7/2020 Gordon ..... A61H 3/008

FOREIGN PATENT DOCUMENTS

CN 111760249 A * 10/2020 ..... A63B 21/00192
WO WO-8601735 A1 * 3/1986
WO WO-2008146083 A2 * 12/2008 ..... A63B 21/0618

* cited by examiner

COMPREHENSIVE PHYSICAL EXERCISING APPARATUS WITH RUNNING EXERCISING FUNCTION AND STRENGTH EXERCISING FUNCTION

FIELD OF THE DISCLOSURE

The disclosure relates to the field of fitness equipment, and more particularly to a comprehensive physical exercising apparatus with running exercising function and strength exercising function.

BACKGROUND OF THE DISCLOSURE

With the improvement of people's health awareness, more and more people pay attention to their own exercise, and more and more people choose to exercise with fitness equipment.

At present, some people like to place fitness equipment at home to facilitate fitness exercising. However, the current fitness equipment has a relatively single function. For example, only running exercising can be carried out on the treadmill, and the strength exercising instrument can only be used for strength exercising. Therefore, the disclosure proposes a comprehensive physical exercising apparatus with running exercising function and strength exercising function.

SUMMARY OF THE DISCLOSURE

An objective of the disclosure is to provide a comprehensive physical exercising apparatus with running exercising function and strength exercising function, so as to solve the problem of single function of current fitness equipment.

In order to achieve the above purpose, the disclosure provides the following technical solution.

Specifically, a comprehensive physical exercising apparatus with running exercising function and strength exercising function may include:

a base configured (i.e., structured and arranged) to be placed on a ground to support the comprehensive physical exercising apparatus of the disclosure;

a strength exercising unit, disposed on the base and configured for strength exercising of fitness personnel; and the strength exercising unit may include: a force-adjustable rotary device fixedly connected to the base and configured for providing a load during the strength exercising of fitness personnel, and pulling ropes fixedly connected to the force-adjustable rotary device and configured for pulling the force-adjustable rotary device during the strength exercising of fitness personnel; and a running exercising unit, disposed on the base and configured for running exercising of fitness personnel.

In an embodiment, the comprehensive physical exercising apparatus may further include: pulling bars hinged to the base; first locking devices disposed on the base and configured for fixing the pulling bars and the base; and first pulley sets disposed on the pulling bars respectively. Each of the first pulley sets may include a pulley seat disposed on a corresponding one of the pulling bars and two fixed pulleys rotatably connected to the pulley seat, and an end of a corresponding one of the pulling ropes away from the force-adjustable rotary device passes between the two fixed pulleys.

In an embodiment, each of the first pulley sets may further include: a pulley sleeve slidably sleeved onto the corresponding one of the pulling bars, where the pulley seat is hinged to the pulley sleeve; and a first fastening screw threadedly connected to the pulley sleeve and configured for fixing the pulley sleeve to the corresponding one of the pulling bars.

In an embodiment, each of the pulling bars may include: a fixing tube hinged to the base, where the first locking device is connected to the fixing tube and the base; at least one group of pulling telescopic tube sleeved in the fixing tube, where a corresponding one of the first pulley sets is installed on the pulling telescopic tube; and a second locking device disposed on the fixing tube and configured for fixing the fixing tube and the pulling telescopic tube.

In an embodiment, a connecting rod is disposed on the pulling telescopic tubes of the pulling bars, the connecting rod is U-shaped, and the connecting rod is connected to the pulling bars respectively located on both sides of the base.

In an embodiment, the comprehensive physical exercising apparatus may further include: a panel bracket hinged to the base. The panel bracket may include: fixing tubes (also referred to as panel fixing tubes) hinged to the base, where the panel fixing tubes are dampingly connected to the base; a telescopic tube (also referred to as panel telescopic tube) arranged on the panel fixing tubes, where a panel fixing clamp is fixedly connected onto the panel telescopic tube; and second fastening screws respectively arranged on the panel fixing tubes and configured for fixing the panel fixing tubes and the panel telescopic tube.

In an embodiment, the comprehensive physical exercising apparatus may further include: a partition plate assembly hinged to the panel bracket. The partition plate assembly may include: a first partition plate hinged to one end of the panel bracket close to the base; a second partition plate hinged to the first partition plate, and at least two groups of partition plate fastening screws arranged on the panel bracket.

In an embodiment, the base may include: a first supporting seat connected to the pulling bars and the force-adjustable rotary device; a second supporting seat hinged to the first supporting seat, and the first supporting seat and the second supporting seat are foldable with respect to each other.

In an embodiment, at least three groups of rollers are fixedly connected to the first supporting seat.

In summary, compared with the prior art, the embodiments of the disclosure mainly have the following beneficial effects:

By setting a strength exercising unit and a running exercising unit, the disclosure has functions of strength exercising and running exercising, provides the functional diversity of fitness equipment, and reduces cost investment of family fitness equipment.

Moreover, the disclosure can also be folded to reduce space occupation of fitness equipment.

Figure 1:
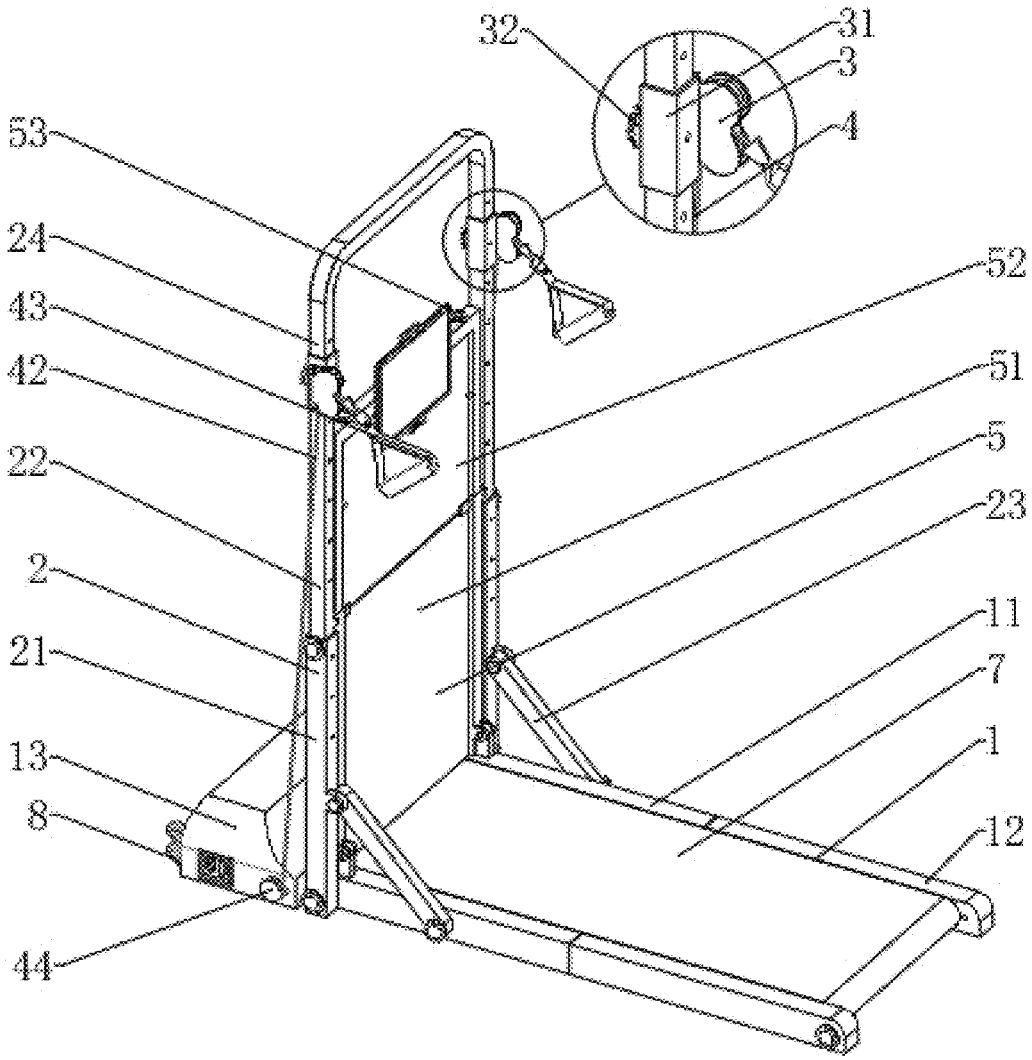
FIG. 1 is a schematic structural diagram of a comprehensive physical exercising apparatus in a vertical strength exercising state of the disclosure.

Description of reference numerals: 1—base, 11—first supporting seat, 12—second supporting seat, 13—motor seat, 2—pulling bar, 21—fixing tube, 22—pulling telescopic tube, 23—supporting rod, 24—connecting rod, 3—first pulley set, 31—pulley sleeve, 32—first fastening screw, 4—strength exercising unit, 41—force-adjustable rotary device, 42—pulling rope, 43—pulling rope handle, 44—second fixed pulley, 5—partition plate assembly, 51—first partition plate, 52—second partition plate, 53—partition plate fastening screw, 6—panel bracket, 61—panel fixing tube, 62—panel telescopic tube, 63—panel fixing clamp, 64—second fastening screw, 7—running exercising unit, 71—driving motor, 72—running belt, 8—pulley.

DETAILED DESCRIPTION OF EMBODIMENTS

The technical solution in the illustrated embodiment of the disclosure will be clearly and completely described below in combination with the accompanying drawings in the illustrated embodiment of the disclosure. Obviously, the described embodiments are only part of embodiments of the disclosure, not all of the embodiments, based on the illustrated embodiments of the disclosure, all other embodiments obtained by those skilled in the art without creative work belong to the protection scope of the disclosure.

Figure 2:
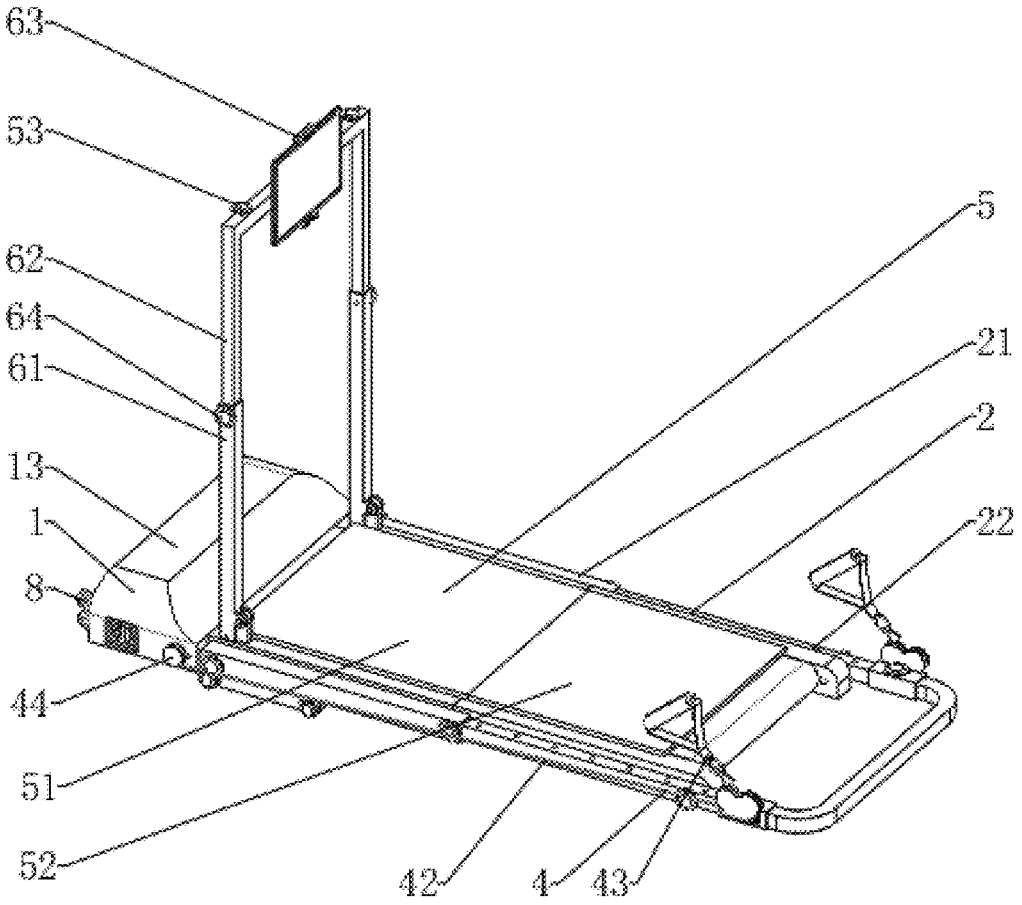
FIG. 2 is a schematic structural diagram of the comprehensive physical exercising apparatus in a horizontal strength exercising state of the disclosure.
Figure 3:
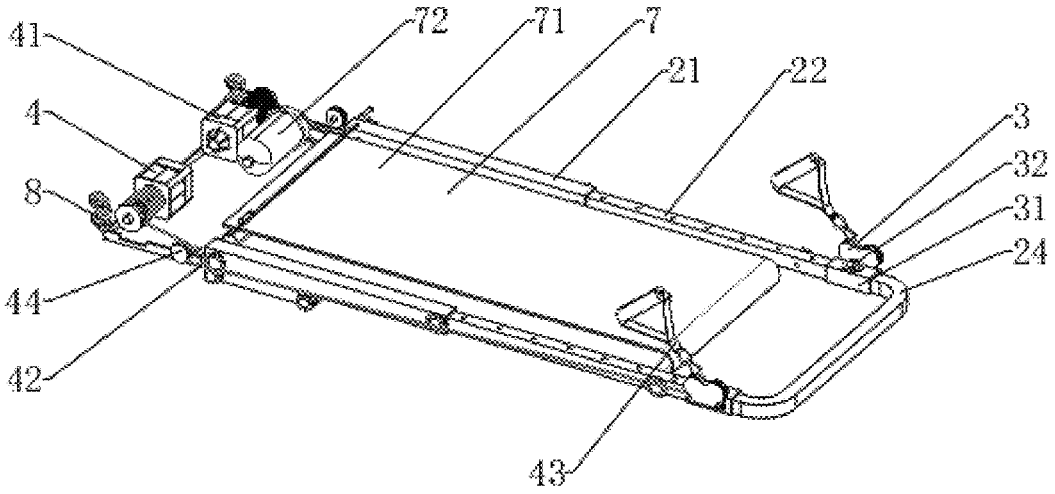
FIG. 3 is a schematic diagram of the internal structure of the base in the disclosure.

Referring to FIGS. 1-3, an illustrated embodiment of the disclosure provides a comprehensive physical exercising apparatus with running exercising function and strength exercising function. The comprehensive physical exercising apparatus may include:

a base 1, configured (i.e., structured and arranged) to be placed on the ground and configured for supporting the comprehensive physical exercising apparatus of the disclosure;

a strength exercising unit 4, disposed on the base 1 and configured for strength exercising of fitness personnel; the strength exercising unit 4 may include: a force-adjustable rotary device 41 fixedly connected to the base 1 and configured for providing a load during the strength exercising of fitness personnel, and pulling ropes 42 fixedly connected to the force-adjustable rotary device 41 and configured for pulling the force-adjustable rotary device 41 during the strength exercising of fitness personnel; and a running exercising unit 7, disposed on the base land configured for running exercising of fitness personnel.

During the strength exercising, the fitness personnel pulls at least one of the pulling ropes 42, the force-adjustable rotary device 41 provides reversed tension to the at least one of the pulling ropes 42, and the fitness personnel can carry out the strength exercising by standing on the base 1 or one side of the base 1.

In some illustrated embodiments, the force-adjustable rotary device 41 may include:

an extension spring fixedly connected to an interior of the base 1, one end of the extension spring is fixedly connected to the interior of the base 1, and the other end of the extension spring is fixedly connected to the pulling ropes 42. When at least one of the pulling ropes 42 is pulled, the force-adjustable rotary device 41 extends. Since the force-adjustable rotary device 41 has a restoring force, the force-adjustable rotary device 41 can provide a load for the strength exercising.

In some illustrated embodiments, the force-adjustable rotary device 41 may also be configured to be other structures. For example, the force-adjustable rotary device 41 may include:

a rope pulley rotatably connected to the base 1, and one end of the pulling ropes 42 are wound on the rope pulley; and a first spring sleeved on a rotating shaft of the rope pulley, one end of the first spring is fixed to the base 1, and the other end of the first spring is fixed to the rope pulley.

When at least one of the pulling ropes 42 is pulled, the at least one of the pulling ropes 42 drives the rope pulley to rotate, and the rope pulley drives the first spring to rotate. Since one end of the first spring is fixed to the base 1, when the first spring rotates, the restoring force of the first spring is used to provide the load of strength exercising.

In some illustrated embodiments, the force-adjustable rotary device 41 may also be electrically driven. For example, the force-adjustable rotary device 41 may include:

a rope pulley rotatably connected to the base 1, and the pulling ropes 42 are wound on the rope pulley; and a driving motor fixedly connected to the base 1, and an output shaft of the driving motor is fixedly connected to a rotating shaft of the rope pulley. When the driving motor is energized, the driving motor can drive the rope pulley to rotate. By pulling the pulling ropes 42, the rope pulley can rotate in an opposite direction of a rotation direction of the driving motor, so that the driving motor can provide load of strength exercising.

In an illustrated embodiment, the strength exercising unit 4 may further include:

a second fixed pulley 44 rotatably connected to the base 1, the pulling ropes 42 are wound on the second fixed pulley 44, and the second fixed pulley 44 is configured to reduce the wear of the pulling ropes 42.

During the running exercising, the fitness personnel stands on the running exercising unit 7 for running exercising.

In some illustrated embodiments, the running exercising unit 7 may include:

at least two groups of transmission rollers rotatably connected to the base 1;

a running belt 72 sleeved on the at least two groups of transmission rollers and configured to carry the fitness personnel during the running exercising; and a driving motor 71 fixedly connected to the base 1 and configured for driving the at least two groups of transmission rollers to rotate.

During the running exercising, the fitness personnel stands on the running belt 72 and start the driving motor 71. The driving motor 71 drives the running belt 72 to rotate. During the rotation of the running belt 72, the fitness personnel can carry out the running exercising.

In some illustrated embodiments, the base 1 is disposed with a running board on an inner side of the running belt 72.

In an embodiment of the disclosure, the comprehensive physical exercising apparatus may further include:

pulling bars 2 hinged to the base 1;

first locking devices disposed on the base 1 and configured for fixing the pulling bars 2 and the base 1; and first pulley sets 3 disposed on the pulling bars 2 respectively, where each of the first pulley sets 3 may include a pulley seat disposed on a corresponding one of the pulling bars 2 and two fixed pulleys rotatably connected to the pulley seat, and one end of a corresponding one of the pulling ropes 42 away from the force-adjustable rotary device 41 passes between the two fixed pulleys.

The setting of the pulling bars 2 and the first pulley sets 3 in the illustrated embodiment enables the comprehensive physical exercising apparatus provided in the illustrated embodiment to carry out both vertical strength exercising and horizontal strength exercising.

During the vertical strength exercising, the fitness personnel rotates the pulling bars 2 so that the pulling bars 2 are perpendicular to the base 1, the pulling bars 2 are fixed to the base 1 through the first locking devices respectively, so that the pulling bars 2 cannot rotate on the base 1. Then, the fitness personnel pulls the pulling ropes 42 away from one end of the force-adjustable rotary device 41, the force-adjustable rotary device 41 provides reversed tension to the pulling ropes 42, and the fitness personnel can carry out the vertical strength exercising when standing on the base 1.

During the horizontal strength exercising, the fitness personnel rotates the pulling bars 2 so that the pulling bars 2 fit on the base 1, and the fitness personnel can pull the pulling ropes 42 while sitting on the base 1. Because each of the first pulley sets 3 is provided with two groups of pulleys and the corresponding one of the pulling ropes 42 passes between the two groups of pulleys, the pulling ropes 42 can turn from both sides of the first pulley sets 3 respectively. During the horizontal strength exercising, the first pulley sets 3 can also control the rotation of the pulling ropes 42, and the fitness personnel can carry out horizontal tension exercising or horizontal push strength exercising.

In an illustrated embodiment, the pulling bar 2 is provided with two groups, the pulling bars 2 are respectively disposed on two sides of the base 1, and the force-adjustable rotary device 41 and the pulling rope 42 are both provided with two groups.

In some illustrated embodiments, the first locking devices are supporting rods 23 hinged to the base 1, and both ends of each of the supporting rods 23 are detachably connected to the pulling bar 2 and the base 1 respectively through bolts. When the pulling bars 2 are perpendicular to the base 1, the supporting rods 23 respectively form triangular structures with the pulling bars 2 and the base 1, thereby preventing the pulling bars 2 from rotating on the base 1.

In an illustrated embodiment of the disclosure, each of the first pulley set 3 may further include:

a pulley sleeve 31 slidably sleeved onto the corresponding one of the pulling bars 2, where the pulley seat is hinged to the pulley sleeve; and a first fastening screw 32 threadedly connected to the pulley sleeve 31 and configured for fixing the pulley sleeve 31 to the corresponding one of the pulling bars 2.

The pulley sleeve 31 is configured to adjust a position of the first pulley set 3 on the pulling bar 2 so that the fitness personnel of different heights can use it.

When adjusting the position of the first pulley set 3, the first fastening screw 32 is loosed, the pulley sleeve 31 is moved so that the pulley sleeve 31 is in a suitable position, then the first fastening screw 32 is tighten, and the first fastening screw 32 is pressed on the pulling bar 2, so as to fix the pulley sleeve 31 to the pulling bar 2.

In some illustrated embodiments, each of the pulley sleeves 31 is a cylindrical shape with openings at both ends, the pulling bars 2 are square tubes, and each of the pulley sleeves 31 is specifically a square cylindrical shape.

In an illustrated embodiment of the disclosure, each of the pulling bars 2 may include:

a fixing tube 21 hinged to the base 1, where the supporting rod 23 is connected to the fixing tube 21 and the base 1;

at least one group of pulling telescopic tubes 22 sleeved in the fixing tube 21, where a corresponding one of the first pulley sets 3 is installed on the pulling telescopic tube 22; and a second locking device disposed on the fixing tube 21 for fixing the fixing tube 21 and the pulling telescopic tube 22.

In the illustrated embodiment, the pulling bars 2 are extendable and retractable, so that the pulling bars 2 can occupy a small space during storage, and the position of the first pulley sets 3 can be adjusted.

In some illustrated embodiments, the fixing tube 21 and the pulling telescopic tube 22 are square tubes, the fixing tube 21 is sleeved on an outside of the pulling telescopic tube 22. When the pulling telescopic tube 22 is provided with two groups, the pulling telescopic tubes 22 are sleeved with each other, and the fixing tube 21 is sleeved on the outermost pulling telescopic tube 22. At this time, the second locking device is arranged on the pulling telescopic tube 22.

When a length of the pulling bar 2 needs to be adjusted, the second locking device is loosed, the pulling telescopic tube 22 is pulled out, so that the length of the pulling bar 2 becomes longer, and then the second locking device is fixed.

In some illustrated embodiments, the second locking device is a second fastening screw 64 arranged on the fixing tube 21 and the pulling telescopic tube 22. When the second fastening screw is tightened, the fixing tube 21 and the pulling telescopic tube 22 are fixedly connected.

In some illustrated embodiments, the second locking device can also be configured to be other structures, such as a locking buckle arranged on the fixing tube 21 or the pulling telescopic tube 22. For the locking buckle, please refer to the locking buckle on a tripod support foot, which will not be repeated here.

In an embodiment of the disclosure, the pulling telescopic tubes 22 are also disposed with a connecting rod 24, the connecting rod 24 is U-shaped, and the connecting rod 24 is connected to the pulling bars 2 on two sides of the base 1 to increase the stability of the pulling bars 2. Moreover, during the running exercising, the fitness personnel can hold the connecting rod 24 to rest.

In an embodiment of the disclosure, one end of the pulling rope 42 away from the force-adjustable rotary device 41 is also disposed with pulling rope handles 43, the pulling rope handles 43 are respectively in triangular frame shapes, and each of the pulling rope handles 43 is disposed with an anti-skid sleeve.

In an embodiment of the disclosure, the comprehensive physical exercising apparatus may further include:

a detection unit fixedly connected to the base 1 and configured for detecting exercising data.

In some illustrated embodiments, the detection unit includes:

a control board (not shown in the drawings) fixedly connected to the base 1, and a control module is arranged on the control board;

a force sensor fixedly connected to the force-adjustable rotary device 41 for detecting the tension of the force-adjustable rotary device 41, and the force-adjustable rotary device 41 is electrically connected to the control board;

a speed sensor arranged in the running exercising unit 7 and configured for detecting running exercising data; and a display module electrically connected to the control board for displaying exercising data.

When detecting strength exercising, the control board detects the tension change through the force sensor and displays it on the display module, and the display module is a display screen.

In some illustrated embodiments, the base 1 is also fixedly connected to a power switch 71, the power switch 71 is electrically connected to the control board, and the power switch is configured to supply power to the control board and the force-adjustable rotary device 41.

In some illustrated embodiments, the speed sensor is a wheel speed sensor, the speed sensor is disposed on the rotating shaft of a corresponding one of the transmission rollers, and the transmission rollers are also disposed with ring gears.

In an embodiment of the disclosure, the comprehensive physical exercising apparatus may further include:

a panel bracket 6 hinged to the base 1 and configured for fixing the display module.

In some illustrated embodiments, the display module is an intelligent flat panel, and the panel bracket 6 may include:

panel fixing tubes 61 (also referred to as fixing tubes) hinged to the base 1, where the panel fixing tubes 61 are dampingly connected to the base 1;

a panel telescopic tube 62 (also referred to as telescopic tube) arranged on the panel fixing tubes 61, where a panel fixing clamp 63 is fixedly connected onto the panel telescopic tube 62; and second fastening screws 64 respectively arranged on the panel fixing tubes 61 and configured for fixing the panel fixing tubes 61 and the panel telescopic tube 62.

In some illustrated embodiments, the panel fixing tube 61 is provided with two groups. The panel fixing tubes 61 are hinged to the base 1 through threaded pins respectively. When the threaded pins are tightened, connecting lugs on the base 1 tightly clamp the panel fixing tubes 61 so that the panel fixing tubes 61 are connected to the base 1.

The panel telescopic tube 62 is U-shaped, and the panel fixing clamp 63 is fixedly connected to the base 1 by screws.

The second fastening screws 64 are connected to the panel fixing tubes 61 through threads respectively, each of the panel fixing tubes 61 is a cylindrical shape with an opening at one end, and the panel fixing tubes 61 are sleeved on the panel telescopic tube 62.

The intelligent flat panel is electrically connected to the control board through a Bluetooth module.

In an embodiment of the disclosure, the comprehensive physical exercising apparatus may further include:

a partition plate assembly 5 hinged to the base 1 for isolating the running exercising unit 7 during horizontal tension exercising.

During the horizontal tension exercising, the partition plate assembly 5 is laid flat so that the partition plate assembly 5 is placed on the running belt 72, and then the angle of the pulling bars 2 is adjusted. During the horizontal tension exercising, the fitness personnel can sit on the partition plate assembly 5 for tension exercising.

In an embodiment of the disclosure, the partition plate assembly 5 may include:

a first partition plate 51 hinged to one end of the panel bracket 6 close to the base 1;

a second partition plate 52 hinged to the first partition plate 51, and at least two groups of partition plate fastening screws 53 arranged on the panel bracket 6.

During the running exercising, the partition plate assembly 5 is coplanar with the panel bracket 6, and the partition plate fastening screws 53 are tightly screwed on the panel bracket 6. At this time, the partition plate fastening screws 53 extend from the panel bracket 6 and are respectively arranged on two sides of the partition plate assembly 5. The partition plate fastening screws 53 can prevent the partition plate assembly 5 from bending, and fix the partition plate assembly 5 to the panel bracket 6.

During the tension exercising, the partition plate assembly 5 is laid flat.

In an embodiment of the disclosure, the base 1 may include:

a first supporting seat 11 connected to the pulling bars 2 and the force-adjustable rotary device 41; and a second supporting seat 12 hinged to the first supporting seat 11. The first supporting seat 11 and the second supporting seat 12 are arranged so that the base 1 can be folded with respect to each other. When storing the comprehensive physical exercising apparatus, rotating the second supporting seat 12 can reduce the occupied area of the base 1.

In some illustrated embodiments, two groups of transmission rollers in the running exercising unit are respectively arranged in the first supporting seat 11 and the second supporting seat 12. When the first supporting seat 11 and the second supporting seat 12 are coplanar, the running belt 72 is flat.

Figure 4:
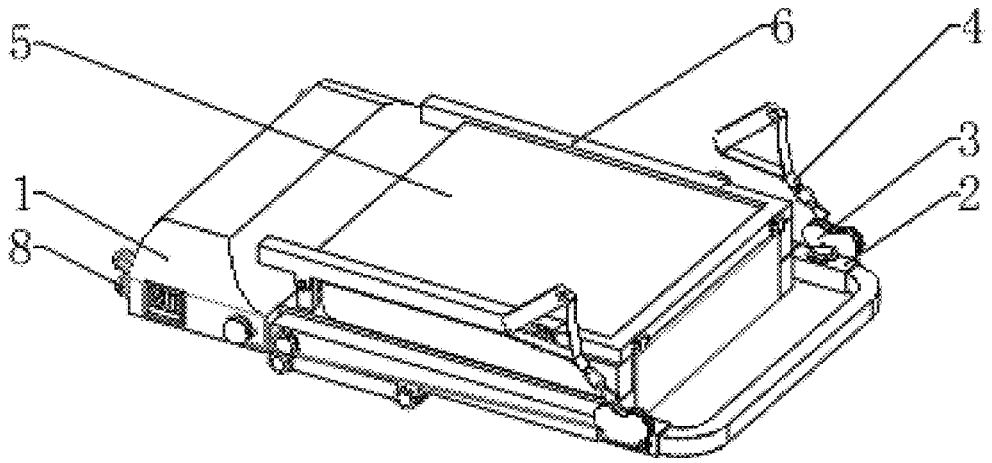
FIG. 4 is a schematic structural diagram from a first viewing angle of the comprehensive physical exercising apparatus in a folded state of the disclosure.
Figure 5:
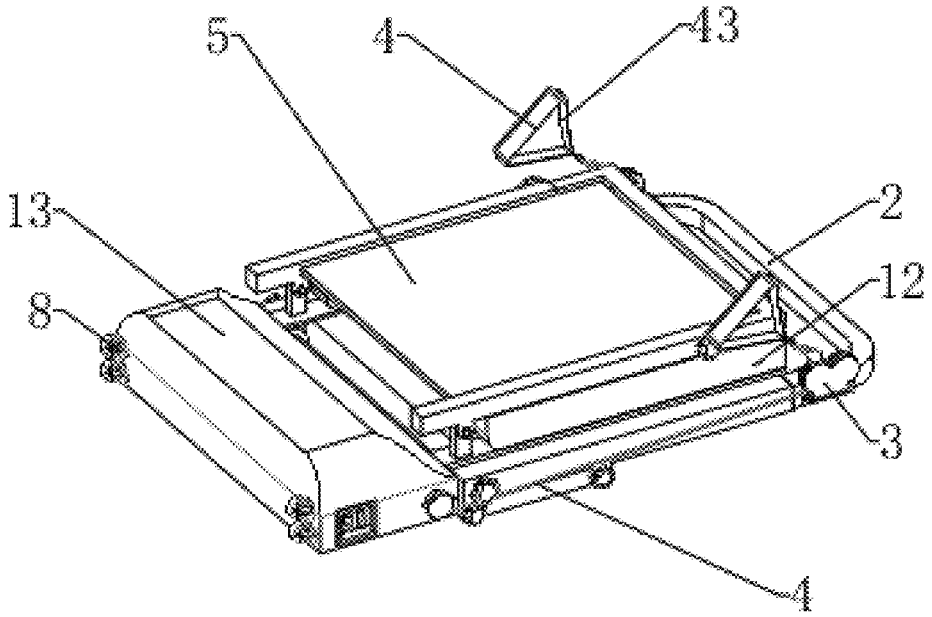
FIG. 5 is a schematic structural diagram from a second viewing angle of the comprehensive physical exercising apparatus in the folded state of the disclosure.

Referring to FIG. 4 and FIG. 5, when storing the comprehensive physical exercising apparatus, bending the first supporting seat 11 and the second supporting seat 12 to reduce the area occupied by the first supporting seat 11 and the second supporting seat 12.

In some illustrated embodiments, the first supporting seat 11 and the second supporting seat 12 are hinged by hinges.

In an illustrated embodiment of the disclosure, the first support base 11 is also disposed with a motor base 13, an interior of the motor base 13 is hollow, and the force-adjustable rotary device 41 and the driving motor 71 are arranged in the motor base 13.

In an illustrated embodiment of the disclosure, at least three groups of pulleys 8 are fixedly connected to the first supporting seat 11.

The setting of the pulleys 8 is convenient for the movement of the comprehensive physical exercising apparatus provided by the disclosure. Referring to FIG. 4, when the first supporting seat 11 and the second supporting seat 12 are folded, the pulleys 8 can be moved after touching the ground.

Although the embodiments of the disclosure have been shown and described, it will be understood to those skilled in the related art that a variety of changes, modifications, substitutions and modifications can be made to these embodiments without departing from the principle and spirit of the disclosure, and the scope of the disclosure is limited by the appended claims and their equivalents.

What is claimed is:

1. A comprehensive physical exercising apparatus with running exercising function and strength exercising function, comprising:

a base configured to be placed on a ground surface;

a strength exercising unit, disposed on the base and configured for strength exercising of a user standing on the base; and a running exercising unit, disposed on the base and configured for running exercising of the user;

wherein the strength exercising unit comprises:

a force-adjustable rotary device, fixedly connected to and contained at least partially within the base, and configured for providing a load during the strength exercising of the user;

pulling ropes, fixedly connected to the force-adjustable rotary device and configured for pulling the force-adjustable rotary device during the strength exercising of the user;

pulling bars, hinged to the base;

first locking devices, disposed on the base and configured for fixing the pulling bars and the base; and first pulley sets, disposed on the pulling bars respectively, wherein each of the first pulley sets comprises a pulley seat disposed on a corresponding one of the pulling bars and two fixed pulleys rotatably connected to the pulley seat, and wherein an end of a corresponding one of the pulling ropes away from the force-adjustable rotary device passes between the two fixed pulleys.

2. The comprehensive physical exercising apparatus according to claim 1, wherein each of the first pulley sets further comprises:

a pulley sleeve, slidably sleeved onto the corresponding one of the pulling bars, wherein the pulley seat is hinged to the pulley sleeve; and a first fastening screw, threadedly connected to the pulley sleeve and configured for fixing the pulley sleeve to the corresponding one of the pulling bars.

3. The comprehensive physical exercising apparatus according to claim 1, wherein each of the pulling bars comprises:

a fixing tube hinged to the base, wherein each first locking device is correspondingly connected to the fixing tube and the base;

at least one group of pulling telescopic tubes sleeved in the fixing tube, wherein a corresponding one of the first pulley sets is installed on the the at least one group of pulling telescopic tubes; and a second locking device, disposed on the fixing tube and configured for fixing the fixing tube and the at least one group of pulling telescopic tubes.

4. The comprehensive physical exercising apparatus according to claim 3, wherein a connecting rod is disposed on the at least one group of pulling telescopic tubes of the pulling bars, the connecting rod is U-shaped, and the connecting rod is connected to the pulling bars respectively located on two sides of the base.

5. The comprehensive physical exercising apparatus according to claim 1, wherein the base comprises:

a first supporting seat connected to the pulling bars and the force-adjustable rotary device; and a second supporting seat hinged to the first supporting seat, wherein the first supporting seat and the second supporting seat are foldable with respect to each other.

6. The comprehensive physical exercising apparatus according to claim 5, wherein at least three groups of pulleys are fixedly connected to the first supporting seat.

7. The comprehensive physical exercising apparatus according to claim 1, further comprising: a panel bracket hinged to the base; wherein the panel bracket comprises:

fixing tubes hinged to the base, wherein the fixing tubes are dampeningly connected to the base;

a telescopic tube arranged on the fixing tubes, wherein a panel fixing clamp is fixedly connected onto the telescopic tube; and fastening screws, respectively arranged on the fixing tubes and configured for fixing the fixing tubes and the telescopic tube.

8. The comprehensive physical exercising apparatus according to claim 7, further comprising: a partition plate assembly hinged to the panel bracket, wherein the partition plate assembly comprises:

a first partition plate, hinged to an end of the panel bracket close to the base;

a second partition plate hinged to the first partition plate, and at least two groups of partition plate fastening screws arranged on the panel bracket.

* * * * *